US006116559A

United States Patent [19]

Lackey

[11] Patent Number: 6,116,559

[45] Date of Patent: Sep. 12, 2000

[54] DOWNROD ADAPTER ASSEMBLY

[75] Inventor: Robert W. Lackey, Hickory, N.C.

[73] Assignee: Prime/Home Impressions, LLC, Hickory, N.C.

[21] Appl. No.: 09/083,715

[22] Filed: May 22, 1998

[51] Int. Cl.[7] ..... B42F 13/00

[52] U.S. Cl. ..... 248/343; 417/360; 416/5; 416/244; 416/246

[58] Field of Search ..... 417/423.15, 360; 416/5, 244, 246; 248/343, 323; 403/299, 307

[56] References Cited

U.S. PATENT DOCUMENTS

| | | | |
|---|---|---|---|
| 3,797,865 | 3/1974 | Ballentine | 285/175 |
| 4,697,777 | 10/1987 | Yang | 248/343 |
| 4,714,230 | 12/1987 | Huang | 248/613 |
| 4,729,725 | 3/1988 | Markwardt . | |
| 5,090,654 | 2/1992 | Ridings et al. | 248/343 |
| 5,151,011 | 9/1992 | Rezek | 416/5 |
| 5,242,269 | 9/1993 | Chang | 416/244 |
| 5,505,420 | 4/1996 | Brown | 248/343 |

*Primary Examiner*—Harold Joyce
*Assistant Examiner*—Derek Boles
*Attorney, Agent, or Firm*—Hardaway/Mann IP Group

[57] ABSTRACT

An apparatus for connecting a downrod to a mounting assembly and a motor housing of a fan. The mounting assembly and the motor housing are capable of receiving a differently sized downrod. The apparatus comprises a pair of adapters. The adapters each have a first end that engages an end of the downrod; a second end that engages either the mounting assembly or the motor housing; and a hollow interior extending between said first and second ends. In one alternative embodiment, the first end receives the downrod and includes: a pair of aligned apertures; and an aperture disposed between the pair of aligned apertures. The second end is threaded and engages either the mounting assembly or the motor housing. The second end includes a pair of aligned apertures on opposite sides thereof. The apparatus also includes a pair of pins to insert through the aligned apertures and a pair of fasteners for securing the downrod within the adapter. In another alternative embodiment, the first end inserts within the downrod. The first end includes a pair of aligned apertures on opposite sides of the first end. The second end is threaded to engage either the mounting assembly or the motor housing. The second end includes: a pair of aligned apertures on opposite sides of the second end. The apparatus also includes a pair of pins for inserting through the aligned apertures to secure either the downrod or the motor housing to the adapter.

21 Claims, 4 Drawing Sheets

DOWNROD ADAPTER ASSEMBLY

BACKGROUND OF THE INVENTION

The present invention relates generally to fan assemblies. Specifically, the present invention relates to an assembly for attaching a downrod between a ceiling fan and the ceiling fan support.

Numerous types of fan assemblies presently exist. Numerous manufacturers produce the various fan assemblies. The components of one manufacturer's fan assembly may not be the same size as the components of another manufacturer's fan assembly. For instance, the ½" diameter and the ¾" diameter are two common sizes of fan assemblies. Recently, the popularity of the larger ¾" diameter fan assemblies has increased over the smaller ½" diameter fan assemblies. The larger sized fan assembly is more popular mainly for reasons not relevant to the present invention.

The trend towards the larger sized fan assembly presents a quandary to the retailer. Currently, the retailer must stock both sizes of fan assembly components. Stocking the less popular, smaller sized fan assembly components wastes valuable shelf space. The shelf space could be more effectively utilized with other products or stocking a larger amount of the more popular, larger sized fan assembly components. Inventory costs and sales volume are potentially affected.

Clearly, there is room for improvement in the art.

SUMMARY OF THE INVENTION

Therefore, it is an object of the present invention to allow the use of common parts on non-standardized products.

It is a further object of the present invention to provide an assembly for attaching a downrod between a ceiling fan and the ceiling fan support.

It is a further object of the present invention to provide an attachment assembly that allows the use of a downrod on a ceiling fan assembly that would not, otherwise, be capable of use with the ceiling fan assembly.

It is a further object of the present invention to reduce the inventory costs of the retailer.

It is a further object of the present invention to decrease the amount of required shelf space to display parts of different sizes.

These and other objects are achieved in one aspect of the present invention by an apparatus for connecting a downrod to a mounting assembly and a motor housing of a fan. The mounting assembly and the motor housing can accommodate only a differently sized downrod. The apparatus comprises a pair of adapters. The adapters each have a first end that engages an end of the downrod; a second end that engages either the mounting assembly or the motor housing; and a hollow interior extending between said first and second ends.

These and other objects are achieved in a second aspect of the present invention by providing an apparatus that connects a downrod to a mounting assembly and a motor housing of a ceiling fan. The mounting assembly and motor housing can accommodate only a differently sized downrod. The apparatus comprises a pair of adapters. The adapters each have a first end; a second end; and a hollow interior. The first end receives the downrod and includes: a pair of aligned apertures; and an aperture disposed between the pair of aligned apertures. The second end is threaded and engages either the mounting assembly or the motor housing. The second end includes a pair of aligned apertures on opposite sides thereof. The apparatus also includes a pair of pins to insert through the aligned apertures; and a pair of fasteners for securing the downrod within the adapter.

These and other objects are achieved in a third aspect of the present invention by providing an apparatus that connects a downrod to a mounting assembly and a motor housing of a ceiling fan. The mounting assembly and motor housing can accommodate only a differently sized downrod. The apparatus comprises a pair of adapters. The adapters each have a first end; a second end; and a hollow interior. The first end inserts within the downrod. The first end includes a pair of aligned apertures on opposite sides of the first end. The second end is threaded to engage either the mounting assembly or the motor housing. The second end includes: a pair of aligned apertures on opposite sides of the second end. The apparatus also includes a pair of pins for inserting through the aligned apertures to secure either the downrod or the motor housing to the adapter.

These and other objects are achieved in a fourth aspect of the present invention by providing a fan assembly comprising, in combination, a mounting assembly adapted to accommodate an end of a first downrod having a size; a motor housing adapted to accommodate the opposite end of the first downrod; a downrod having a size different than the first downrod so that the mounting assembly and the motor housing cannot accommodate the downrod; and a pair of adapters. Each of said adapters has a first end engageable with an end of the downrod; a second end engageable with either the mounting assembly or the motor housing; and a hollow interior extending between the first and second ends. The adapters allow a connection between the downrod, mounting assembly and motor housing.

BRIEF DESCRIPTION OF THE DRAWINGS

The features of the present invention will become apparent to those skilled in the art to which the present invention relates from reading the following specification with reference to the accompanying drawings in which.

DETAILED DESCRIPTION OF THE PREFERRED EMBODIMENTS

Figure 1:
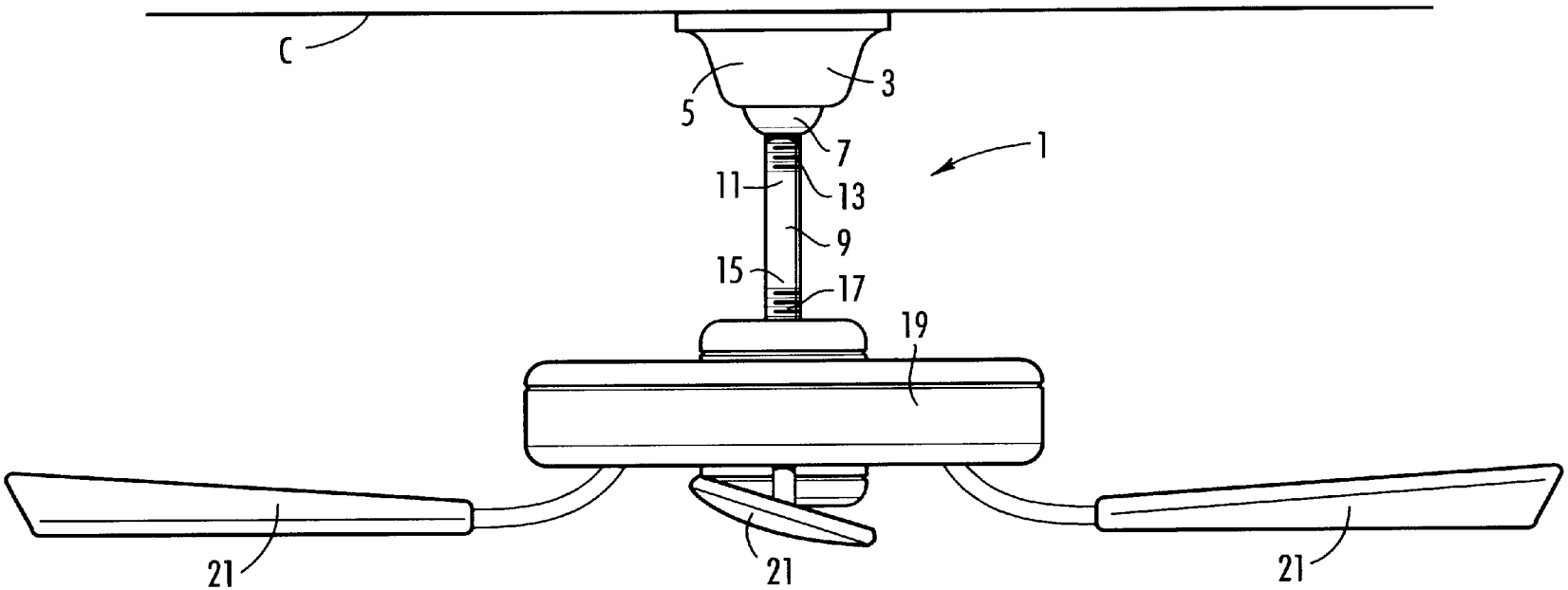
FIG. 1 PRIOR ART
FIG. 1 is an elevational view of a conventional ceiling mounted fan assembly.

FIG. 1 displays a conventional ceiling mounted fan assembly 1. Fan assembly 1 includes a mounting assembly 3 for securing to ceiling C; a downrod 9; and a motor housing 19. Mounting assembly 3 includes a canopy 5, a bracket (not shown) and a hanger ball 7. A brief discussion of mounting assembly 3 follows. A more detailed discussion of a typical ceiling fan mounting assembly can be found in U.S. Pat. No. 4,729,725 to Markwardt, herein incorporated by reference.

The bracket of mounting assembly 3 secures to ceiling C using known techniques, typically securing to a junction box (not shown) extending through an aperture (not shown) in ceiling C. The junction box provides the electric wiring (not shown) for fan assembly 1.

Hanger ball 7 seats in the bracket using known techniques. Typically, hanger ball 7 is semi-spherical. But, hanger ball 7 can have any suitable shape. Hanger ball 7 may be adjustably positionable within the bracket in order, for example, to allow fan assembly 1 to extend from an angled ceiling.

Hanger ball 7 receives one end 11 of downrod 9 through an aperture (not shown). End 11 of downrod 9 can secure to hanger ball 7, for example, by using threads on the hanger ball aperture and complementary threads 13 on downrod 9. Applicant recognizes that any other method of securing downrod 9 to hanger ball 7 can be used. For instance, end 11 of downrod 9 can have aligned apertures (not shown) on opposite sides which receive a removable pin. The removable pin seats within recesses (not shown) in hanger ball 7, preventing end 11 of downrod 9 from exiting the aperture in hanger ball 7. The wiring from the junction box is run through the hollow interior (not shown) of downrod 9.

Canopy 5 serves aesthetic purposes. Canopy 5 encloses the bracket and a portion of hanger ball 7. Canopy 5 also covers the aperture in the ceiling, the junction box and the electrical wiring. A portion of hanger ball 7 extends through a central aperture in canopy 5. Canopy 5 can secure to the bracket using, for example, fasteners.

Opposite end 15 of downrod 9 secures to motor housing 19. As with the connection to hanger ball 7, downrod 9 could also secure to motor housing 19 using conventional techniques. For instance, an aperture (not shown) in motor housing 19 could include threads (now shown) complementary to threads 17 on opposite end 15 of downrod 9. Fan blades 21 extend from motor housing 19.

Figure 2:
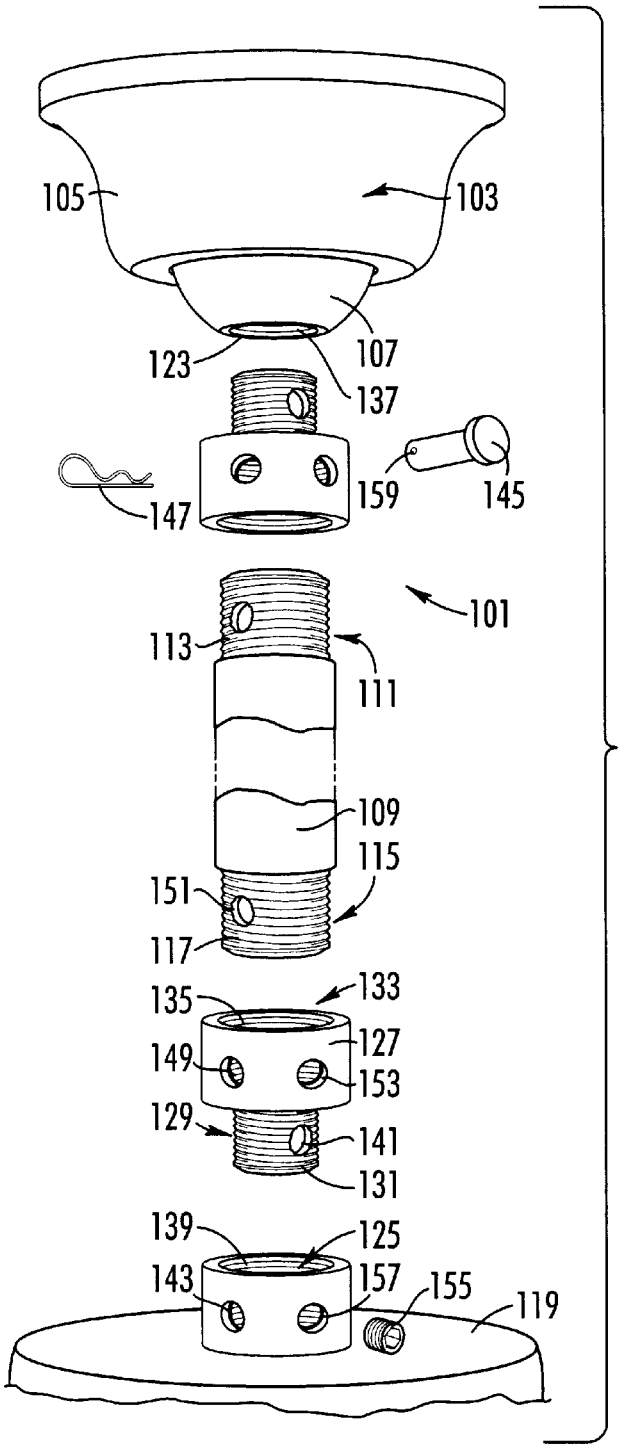
FIG. 2 is an exploded perspective view of a portion of a ceiling mounted fan assembly utilizing a first alternative embodiment of the present invention.
Figure 3:
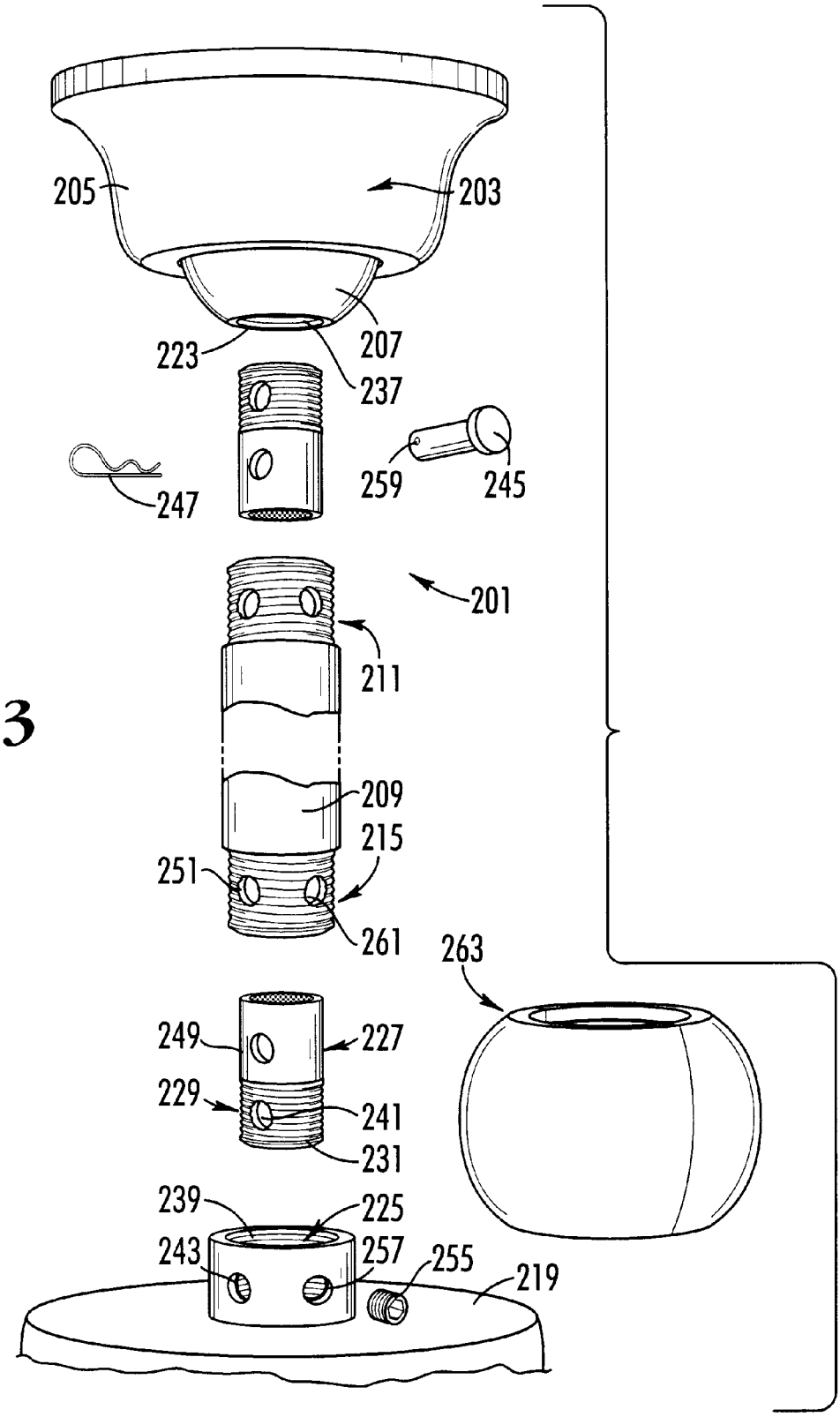
FIG. 3 is an exploded perspective view of a portion of a ceiling mounted fan assembly utilizing a second alternative embodiment of the present invention.
Figure 4:
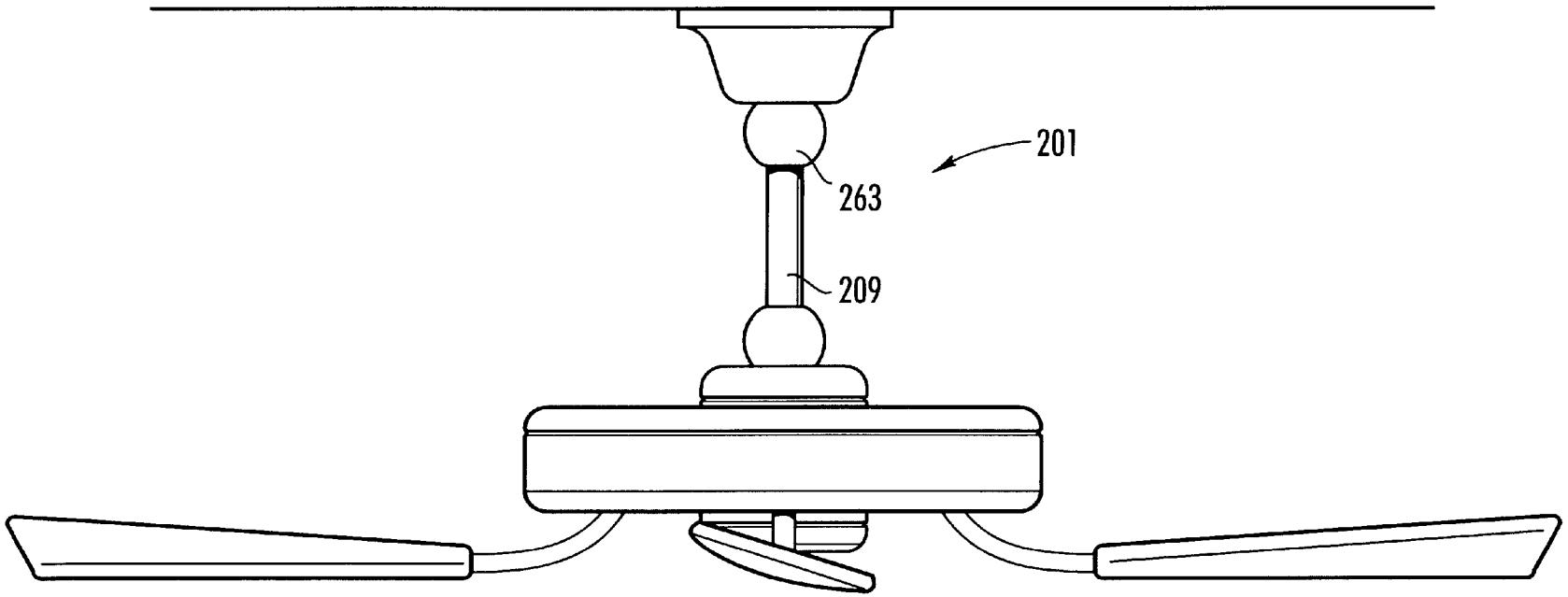
FIG. 4 is an elevational view of the ceiling mounted fan assembly utilizing the second alternative embodiment of the present invention shown in FIG. 3.

FIGS. 2–4 demonstrate ceiling fan assemblies using alternative embodiments of the present invention. Features common to conventional ceiling fan assembly 1 in FIG. 1 use the same reference character, except for a change in the hundred digit. Each alternative embodiment will now be described in detail.

FIG. 2 displays a first alternative embodiment of the present invention, a ceiling mounted fan assembly 101. Fan assembly 101 includes a mounting assembly 103 for securing to the ceiling; a downrod 109; a motor housing 119. Mounting assembly 103 includes a canopy 105, a bracket (not shown) and a hanger ball 107. Mounting assembly 103 attaches to the ceiling in the same manner as mounting assembly 3 in conventional fan assembly 1.

As clearly shown in FIG. 2, downrod 109 has a size that is not capable, by itself, of direct attachment between mounting assembly 103 and motor housing 119. Ends 111, 115 of downrod 109 are too large to secure within aperture 123 of hanger ball 107 or aperture 125 of motor housing 119. Stated differently, FIG. 2 shows ends 111, 115 of downrod 109 as having an outer diameter greater than an inner diameter of apertures 123, 125. As an example, downrod 109 could have a ¾" diameter, with hanger ball 107 and motor housing 119 adapted to accommodate a ½" diameter downrod.

Clearly, the present invention could also operate if downrod 109 was too small to secure within aperture 123 of hanger ball 107 or aperture 125 of motor housing 119. Stated differently, ends 111, 115 of downrod 109 have an outer diameter less than the inner diameter of apertures 123, 125. With a downrod 109 sized too small, outer surface of downrod 109 cannot directly engage the inner surface of apertures 123, 125.

In order to accommodate downrods 109 sized either too small or too large for direct attachment to mounting assembly 103 or motor housing 119, the present invention uses a pair of adapters 127, one at each end 111, 115 of downrod 109. Adapters 127 have a hollow interior to allow the electric wiring to pass therethrough. One end 129 of adapter 127 is appropriately sized for insertion with either aperture 123 of hanger ball 107 or aperture 125 of motor housing 119. End 129 can have threads 131 to engage complementary threads 137 in aperture 123 or to engage complementary threads 139 in aperture 125. In order to allow the fastening of adapter 127 to motor housing 119 or hanger ball 107, end 129 of adapter 127 must have the same outer diameter as a properly sized downrod.

Opposite sides of end 129 include aligned apertures 141 to allow a pin (not shown) to pass therethrough. When adapter 127 is secured to hanger ball 107, the pin can be used to prevent adapter 127 from exiting hanger ball 107 as discussed in conventional fan assembly 1. When adapter 127 is secured to motor housing 119, apertures 141 are aligned with apertures 143 in motor housing 119 to allow a pin 145 to be inserted therethrough. A locking pin, such as cotter pin 147, can be inserted through an aperture 159 in a distal end of pin 145. Pin 145 retains adapter 127 within motor housing 119. Cotter pin 147 retains pin 145 within apertures 141, 143.

Once adapter 127 is attached to motor housing 119, a set screw 155 can be inserted into an aperture 157. Set screw 155 is tightened against the outer surface of first end 129 of adapter 127. One end of set screw 155 has a recess to accommodate a tool head, such as the head of an allen wrench. Set screw 155 retains adapter 127 within motor housing 119.

Second end 133 of adapter 127 is appropriately sized to receive downrod 109. Since downrod 109 can either be too small or too large, second end 133 can have a smaller diameter or a larger diameter, respectively, than first end 129. Second end 133 includes threads 135 to engage complementary threads 117 on downrod 109. Downrod 109 is rotated within second end 133 to secure downrod 109 and adapter 127 together.

Opposite sides of second end 133 of adapter 127 include aligned apertures 149. Apertures 149 can be aligned with apertures 151 in downrod 109 to allow insertion of pin 145. As discussed above, cotter pin 147 can be inserted through aperture 159 in pin 145. Pin 145 retains downrod 109 within adapter 127.

Once downrod 109 attaches to adapter 127, a set screw 155 can be inserted into an aperture 153. Set screw 155 is tightened against the outer surface of downrod 109. This also ensures that downrod 109 remains within adapter 127.

FIGS. 3 and 4 display a second alternative embodiment of the present invention, a ceiling mounted fan assembly 201. Fan assembly 201 includes a mounting assembly 203 for securing to the ceiling; a downrod 209; and a motor housing 219. Mounting assembly 203 includes a canopy 205, a bracket (not shown) and a hanger ball 207. Mounting assembly 203 attaches to the ceiling in the same manner as mounting assembly 3 in conventional fan assembly 1.

As clearly shown in FIG. 3, downrod 209 has a size that does not allow for direct attachment to mounting assembly 203 and motor housing 219. Ends 211, 215 of downrod 209 are too large to secure within aperture 223 of hanger ball 207 or aperture 225 of motor housing 219. Stated differently, FIG. 3 shows ends 211, 215 of downrod 209 as having an outer diameter greater than an inner diameter of apertures 223, 225.

Clearly, the present invention could also operate if downrod 209 was too small to secure within aperture 223 of hanger ball 207 or aperture 225 of motor housing 219. Stated differently, ends 211, 215 of downrod 209 would have an outer diameter less than the inner diameter of apertures 223, 225. With a downrod 209 too small to directly secure to mounting assembly 103 or motor housing 119, outer surface of downrod 209 cannot engage the inner surface of apertures 223, 225.

In order to accommodate downrod 209, the present invention uses a pair of adapters 227, one at each end 211, 215 of downrod 209. Adapter 227 has a hollow interior to allow the electric wiring to pass therethrough. One end 229 of adapter 227 is appropriately sized for insertion with either aperture 223 of hanger ball 207 or aperture 225 of motor housing 219. End 229 can have threads 231 to engage complementary threads 237 in aperture 223 or to engage complementary threads 239 in aperture 225. In order to allow the fastening of adapter 227 to motor housing 219 or h anger ball 207, end 229 of adapter 227 must have the same outer diameter as a properly sized downrod.

Opposite sides of end 229 include aligned apertures 241 to allow a pin (not shown) to pass therethrough. When adapter 227 is secured to hanger ball 207, the pin can be used to prevent adapter 227 from exiting hanger ball 207 as discussed in conventional fan assembly 1. When adapter 227 is secured to motor housing 219, apertures 241 can also be aligned with apertures 243 in motor housing 219 to allow a pin 245 to be inserted therethrough. A locking pin, such as cotter pin 247, can be inserted through an aperture 259 in a distal end of pin 245. Pin 245 retains adapter 227 within motor housing 219. Cotter pin 247 retains pin 245 within apertures 241, 243.

Once adapter 227 is attached to motor housing 219, a set screw 255 can be inserted into an aperture 257. Set screw 255 is tightened against the outer surface of first end 229 of adapter 227. Set screw retains adapter 227 within motor housing 219.

Second end 233 of adapter 227 is appropriately sized for insertion within the hollow interior of downrod 209. Since downrod 209 can either be too small or too large, second end 233 can have a smaller diameter or a larger diameter, respectively, than first end 229.

FIG. 3 demonstrates that second end 233 can have a smooth outer surface, along with the hollow interior of downrod 209. In order to secure downrod 209 and adapter 227 together, opposite sides of second end 233 can include aligned apertures 249. Apertures 249 are positioned with aligned apertures 251 in downrod 209 to allow insertion of pin 245. As discussed above, cotter pin 247 can be inserted through aperture 259 in the distal end of pin 245. Pin 245 retains adapter 227 within downrod 209. Cotter pin 247 retains pin 245 within apertures 249, 251.

Applicant also contemplates other ways of securing adapter 227 to downrod 209. For example, second end 233 could be threaded (not shown) to engage complementary threads (not shown) on the inner surface of downrod 209. In this manner, adapter 227 can be rotated within downrod 209 to secure downrod 209 and adapter 227 together. For additional securement, the aforementioned pin 245 and cotter 247 can also be used.

Once adapter 227 is attached to downrod 209, a set screw 255 can be inserted into an aperture 261 in downrod 209. Set screw 255 is tightened against the outer surface of adapter 227. This also ensures that adapter 227 remains within downrod 209.

Fan assembly 201 includes decorative covers 263. Cover 263 is preferably made from two pieces, securable together using known techniques such as, for example, fasteners or a snap-fit arrangement. Covers 263 hide the downrod 209/fastener 227 connection and the fastener 227/motor housing 219 connection at one end; and the downrod 209/fastener 227 connection and the fastener 227/mounting assembly 203 connection at the opposite end. FIG. 4 demonstrates fan assembly 201 utilizing covers 263. Covers 263 disguise the fact that downrod 209 is not sized properly. Applicant recognizes that covers 263 can also be used with fan assembly 101 or any other embodiment of the present invention.

All of the components described herein can be manufactured using any suitable method and any suitable material. For instance, the adapters can be manufactured from metal using machining or die casting. The adapters can have a white, bright brass, or antique brass finish. The pins, cotter pins and set screws can be manufactured from metal using machining or die casting. The pins, cotter pins and set screws can have a white, bright brass, or antique brass finish. The covers can be manufactured from plastic or metal using injection molding or die casting. The covers can have a white, bright brass or antique brass finish.

Applicants understand that many other variations are apparent to one of ordinary skill in the art from a reading of the above specification. Such variations are within the spirit and scope of the instant invention as defined by the following appended claims.

I claim:

1. An apparatus for connecting a downrod having a size to a mounting assembly and a motor housing of a fan, the mounting assembly and the motor housing each adapted to receive a differently sized downrod, the apparatus comprising:

a pair of adapters, each of said adapters comprising:

a first end adapted to engage a respective end of the differently-sized downrod, said first end having an inside and outside diameter;

a second end adapted to engage one of the mounting assembly and the motor housing, said second end having a diameter;

a hollow interior extending between said first and second ends; and securing means for connecting said first end to said differently-sized downrod;

wherein said second end of at least one of said pair of adapters has an outer circumference with threads thereon for engaging corresponding threads on one of the mounting assembly and the motor housing; and wherein said second end of said at least one of said pair of adapters further comprises aligned apertures on opposite sides of said second end, said aligned apertures in communication with said hollow interior and adapted to align with apertures in said motor housing;

wherein said adapters are adapted for tandem use to connect a first end of said differently-sized downrod to said motor housing and a second end of said differently-sized downrod to said mounting assembly.

2. The apparatus for connecting a downrod to a mounting assembly and a motor housing of a fan as recited in claim 1, wherein said diameter of said second end is greater than said diameter of said first end.

3. The apparatus for connecting a downrod to a mounting assembly and a motor housing of a fan as recited in claim 1, wherein said diameter of said second end is less than said diameter of said first end, and wherein said first end is of uniform outside diameter, and said second end is adapted to completely fit within said one of the mounting assembly and the motor housing leaving only said first end exposed.

4. The apparatus for connecting a downrod to a mounting assembly and a motor housing of a fan as recited in claim 1, wherein a portion of each of said hollow interiors of said pair of adapters adjacent said first end includes threads for engaging corresponding threads on an outer surface of the downrod when the downrod is inserted within said hollow interior.

5. The apparatus for connecting a downrod to a mounting assembly and a motor housing of a fan as recited in claim 4, further comprising:

a pair of pins;

wherein each of said first ends of said pair of adapters includes aligned apertures on opposite sides thereof, said aligned apertures in communication with said hollow interior and adapted to align with apertures in the improperly sized downrod, said apertures accommodating one of said pair of pins therethrough.

6. The apparatus for connecting a downrod to a mounting assembly and a motor housing of a fan as recited in claim 4, further comprising:

a pair of fasteners;

wherein each of said first ends of said pair of adapters includes an aperture in communication with said hollow interior, said aperture accommodating one of said pair of fasteners therein for securing the improperly sized downrod within said adapter.

7. The apparatus for connecting a downrod to a mounting assembly and a motor housing of a fan as recited in claim 1, further comprising:

a pair of covers, each one of said pair of covers encircling at least a portion of a respective adapter.

8. The apparatus for connecting a downrod to a mounting assembly and a motor housing of a fan as recited in claim 1, further comprising:

a pair of pins;

wherein each of said first ends of said pair of adapters further comprise aligned apertures on opposite sides of said first end, said adapters insertable within respective ends of said improperly sized downrod and alignable with apertures in the improperly sized downrod;

wherein said aligned apertures in each of said first ends of said adapters accommodate a respective one of said pins therein.

9. An apparatus for connecting a downrod having a size to a mounting assembly and a motor housing of a ceiling fan, the mounting assembly and the motor housing each adapted to receive a differently sized downrod, the apparatus comprising:

a pair of adapters, each adapter comprising:

a first end positionable adjacent to an end of the improperly sized downrod, said first end comprising:

a pair of aligned apertures on opposite sides thereof; and an aperture disposed circumferentially between said pair of aligned apertures;

a hollow interior extending from said first end and in communication with said aligned apertures and said aperture of said first end, said hollow interior having threads adjacent said first end for securing the end of the improperly sized downrod therein;

a threaded second end opposite said first end and adapted to engage one of the mounting assembly and the motor housing, said second end comprising:

a pair of aligned apertures on opposite sides thereof and in communication with said hollow interior;

a pair of pins, each pin removably inserted through said aligned apertures of one of said pairs of aligned apertures in said adapter for securing one of the improperly sized downrod and the motor housing to said adapter; and a pair of fasteners, each fastener removably inserted into said aperture in said first end of a respective one of said pair of fasteners for securing the improperly sized downrod within said adapter;

wherein said adapters are adapted for tandem use to connect a first end of said downrod to said motor housing and a second end of said downrod to said mounting assembly.

10. The apparatus for connecting a downrod to a mounting assembly and a motor housing of a ceiling fan as recited in claim 9, wherein said fasteners comprise set screws.

11. The apparatus for connecting a downrod to a mounting assembly and a motor housing of a ceiling fan as recited in claim 9, further comprising:

a pair of lock pins, each lock pin removably inserted into an aperture in a distal end of a respective one of said pair of pins to prevent said pair of pins from exiting said pair of adapters.

12. The apparatus for connecting a downrod to a mounting assembly and a motor housing of a ceiling fan as recited in claim 9, further comprising:

a pair of covers, each one of said pair of covers encircling at least a portion of a respective one of said pair of adapters.

13. The apparatus for connecting a downrod to a mounting assembly and a motor housing of a ceiling fan as recited in claim 9, wherein said first end of said pair of adapters has an inner diameter of approximately ¾" and said second end of said pair of adapters has an outer diameter of approximately ½".

14. An apparatus for connecting a downrod having a size to a mounting assembly and a motor housing of a ceiling fan, the mounting assembly and the motor housing each adapted to receive a differently sized downrod, the apparatus comprising:

a pair of identical adapters, each of said identical adapters comprising:

a first end adapted to insert within a respective end of the improperly sized downrod, said first end comprising:

a pair of aligned apertures on opposite sides of said first end;

a circumferentially threaded second end adapted to engage one of the mounting assembly and the motor housing, said second end comprising:

a pair of aligned apertures on opposite sides of said second end; and a hollow interior extending between said first and second ends and in communication with said aligned apertures of said first and second ends; and a pair of pins, each pin removably inserted through one of said pairs of aligned apertures in one of said identical adapters for securing one of the improperly sized downrod and the motor housing to one of said identical adapters;

wherein said identical adapters are adapted for tandem use to connect a first end of said downrod to said motor housing and a second end of said downrod to said mounting assembly.

15. The apparatus for connecting a downrod to a mounting assembly and a motor housing of a ceiling fan as recited in claim 14, further comprising:

a pair of covers, each one of said pair of covers encircling at least a portion of a respective one of said pair of adapters.

16. The apparatus for connecting a downrod to a mounting assembly and a motor housing of a ceiling fan as recited in claim 14, further comprising:

a pair of lock pins, each lock pin removably inserted into an aperture in a distal end of a respective one of said pair of pins to prevent said pair of pins from exiting said pair of adapters.

17. The apparatus for connecting a downrod to a mounting assembly and a motor housing of a ceiling fan as recited in claim 14, wherein said first end of said pair of adapters has an outer diameter of less than approximately ¾" and greater than approximately ½"; and said second end of said pair of adapters has an outer diameter of approximately ½".

18. A fan assembly comprising, in combination:

a mounting assembly adapted to accommodate an end of a first downrod having a size;

a motor housing adapted to accommodate the opposite end of the first downrod;

a downrod having a size different than the first downrod so that said mounting assembly and said motor housing cannot accommodate said downrod; and a pair of adapters, each of said adapters comprising:

a first end engageable with an end of said downrod, said first end having a diameter;

a second end engageable with one of said mounting assembly and said motor housing, said second end having a diameter and an outer circumference with threads thereon; and a hollow interior extending between said first and second ends;

wherein said pair of adapters allow a connection between said downrod, said mounting assembly and said motor housing;

wherein said pair of adapters are adapted for tandem use to connect a first end of said downrod to said motor housing and a second end of said downrod to said mounting assembly.

19. The apparatus for connecting a downrod to a mounting assembly and a motor housing of a fan as recited in claim 1, wherein said diameter of said second end is about the same as said diameter of said first end.

20. The apparatus for connecting a downrod to a mounting assembly and a motor housing of a fan as recited in claim 1, wherein said securing means is selected from the group consisting of a pin, a screw and a fastener.

21. The apparatus for connecting a downrod to a mounting assembly and a motor housing of a fan as recited in claim 18 wherein said connection between said downrod, said mounting assembly and said motor housing has a uniform diameter for aesthetic appeal.

* * * * *